US005695185A

United States Patent [19]

Bell

[11] Patent Number: 5,695,185

[45] Date of Patent: Dec. 9, 1997

[54] APPARATUS AND METHOD FOR TURNING AND ORIENTING ARTICLES WITHIN AN ARTICLE PATHWAY

[75] Inventor: David L. Bell, Oquawka, Ill.

[73] Assignee: Baldwin Technology Corporation, Rosemont, Ill.

[21] Appl. No.: 539,836

[22] Filed: Oct. 6, 1995

[51] Int. Cl.[6] ..... B65H 29/00

[52] U.S. Cl. ..... 271/185

[58] Field of Search ..... 271/186, 185, 271/225

[56] References Cited

U.S. PATENT DOCUMENTS

| | | |
|---|---|---|
| 2,823,788 | 2/1958 | Chase . |
| 3,758,104 | 9/1973 | Daily . |
| 4,085,839 | 4/1978 | Crawford . |
| 4,527,792 | 7/1985 | Burkhardt . |
| 4,607,743 | 8/1986 | Elam . |
| 4,928,807 | 5/1990 | Auerbach . |
| 4,955,965 | 9/1990 | Mandel . |
| 4,967,899 | 11/1990 | Newsome . |
| 5,012,915 | 5/1991 | Kristola et al. . |
| 5,056,772 | 10/1991 | Kellum, III . |
| 5,090,683 | 2/1992 | Kamath et al. . |
| 5,114,137 | 5/1992 | Olson . |
| 5,180,154 | 1/1993 | Malick . |
| 5,180,159 | 1/1993 | Malick . |
| 5,188,355 | 2/1993 | Lowell et al. . |
| 5,282,528 | 2/1994 | Hudson . |
| 5,318,285 | 6/1994 | Edwards et al. . |
| 5,333,851 | 8/1994 | Kulpa . |
| 5,362,039 | 11/1994 | Kusters . |
| 5,413,326 | 5/1995 | Wright . |

FOREIGN PATENT DOCUMENTS

| | | | |
|---|---|---|---|
| 2152845 | 6/1990 | Japan | 271/186 |

*Primary Examiner*—David H. Bollinger
*Attorney, Agent, or Firm*—Roberts & Mercanti, LLP

[57] ABSTRACT

The present invention discloses an article orienting apparatus for use in a printing process. The apparatus includes a power roller inclined at an acute angle to the article path for wrappingly receiving an article. The article is moved from a first orientation to a second orientationm. The apparatus further includes a second drum for inverting the moving articles.

8 Claims, 5 Drawing Sheets

APPARATUS AND METHOD FOR TURNING AND ORIENTING ARTICLES WITHIN AN ARTICLE PATHWAY

BACKGROUND OF THE INVENTION

The present invention relates generally to a method and apparatus for re-orienting articles as they move between an input and output portion of an article handling system. More particularly, in the preferred embodiment the present invention relates to an article handling system utilized in a printing process.

Web printing is one type of printing process that can utilize an article handling system for re-orienting articles. Web printing is a high speed process that involves printing from a continuous web(s) of paper, merging web(s), cutting the web(s), and folding the resulting cut product into individual articles known as signatures. The resulting signatures are delivered onto a moving conveyor in a lapped or shingled arrangement to create a continuous stream of signatures. With the recent advancements in technology, modern web printing can deliver an output in access of 100,000 signatures per hour. A signature can either be a finished product such as an advertisement, or a subcomponent of a larger product that in a later step will be merged and bound into a final finished product. Depending upon the particular requirements of the specific signature, they may require additional finishing such as gluing, stapling, and trimming.

A typical finishing process for signatures cut from a moving web(s) is to trim three sides of the signature. Prior designers of finishing systems for web printing have generally utilized rotary knives to trim the edges of the signatures. In the prior trimming process a signature is separated from the shingled arrangement of signatures and passed through a set of rotary knives to trim two of the opposed edges of the signature. Upon the signature exiting from the rotary knives it is directed against a fixed stop which is generally known as a "bump turn" and then dropped onto a power conveyor oriented at a ninety degree angle from the trimming process. This power conveyor delivers the signature to a third rotary knife station, wherein a third edge of the signature is trimmed. Historically, this had been the generally accepted manufacturing technique to produce a finished signature, however, throughput from this type of finishing system is limited to 15,000 signatures per hour. In view of the higher speed requirements of todays web printing systems an output of 15,000 signatures per hour is unacceptable.

In response to the improvements in web printing systems and the associated requirement for higher throughput, engineers have developed improved rotary trimmers to allow the signatures to remain in a shingled stream and thereby increase the finishing station. Refinements to the "bump turn" are generally known in the art and are generally comprised of a combination of angles, such as 30/60 degrees and 45/45 degrees all of which together produce a 90° final outcome for turning the signature.

Even with a variety of earlier designs there remains a need for an improved apparatus and method for turning and orienting articles within an article pathway. The present invention satisfies this need in a novel and unobvious way.

SUMMARY OF THE INVENTION

To address the unmet needs of prior article handling systems, the present invention contemplates an apparatus for re-orienting moving articles from a first orientation to a second orientation. The apparatus comprises a article pathway; and a rotatable re-orienting drum positioned within the pathway and oriented with its axis of rotation at an acute angle to the pathway for re-orienting the articles from the first orientation to the second orientation while the articles pass around at least a portion thereof.

One object of the present invention is to provide an improved apparatus for turning and orienting articles within an article pathway having these desirable attributes.

Further objects and advantages of the present invention will be apparent from the following description.

DESCRIPTION OF THE PREFERRED EMBODIMENT

Figure 1:
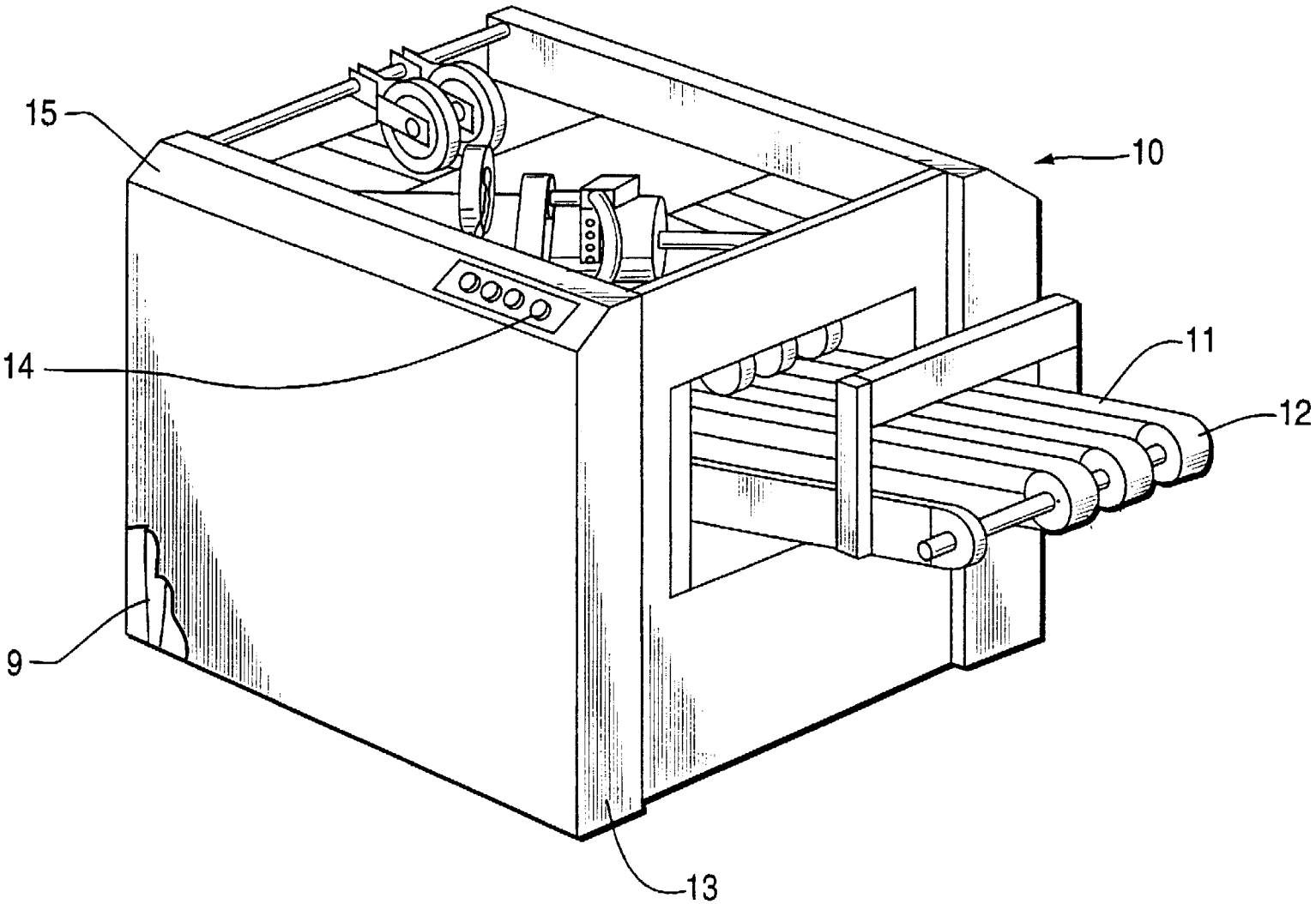
FIG. 1 is a perspective view of the apparatus for turning and re-orienting articles within a pathway according to one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 3:
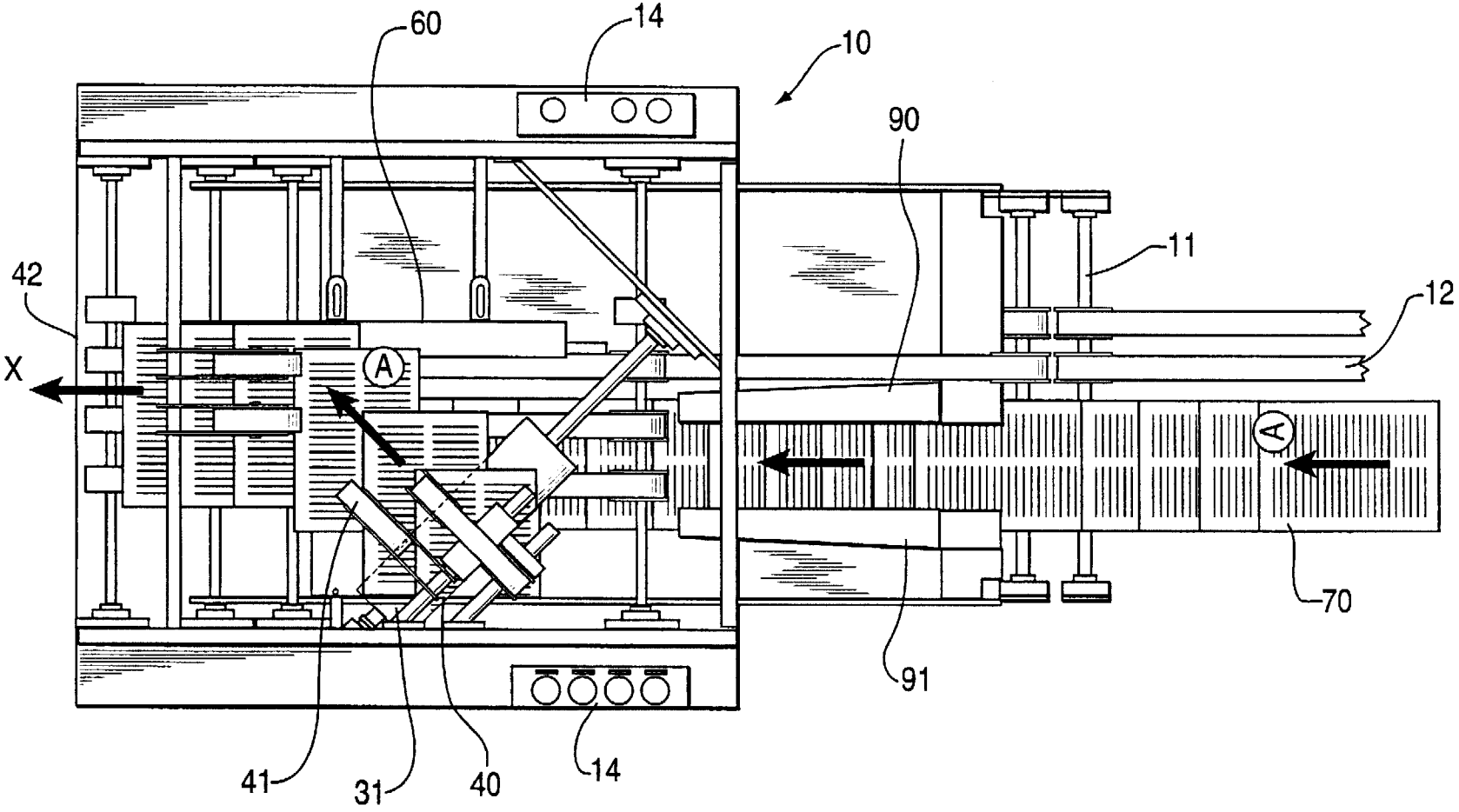
FIG. 3 is a top plan view of the apparatus of FIG. 1 for turning and re-orienting articles within a pathway.

Referring to FIG. 1, there is illustrated an apparatus 10 for turning and orienting articles within an article pathway. Hereinafter, the term article includes but is not limited to documents, envelopes, plain paper, folded paper and other similar material. Apparatus 10 is designed and manufactured in accordance with the present invention. A powered input conveyor 11 having a plurality of elastic belts 12 connected thereto provides the initial induction of the articles into the apparatus 10. The input conveyor 11 is attached to the structure of apparatus 10 and is designed for complete integration with an upstream output station from an article handling or printing system. The infrastructure of apparatus 10 comprises a frame 9 and external covers 13. In the preferred embodiment the frame 9 and covers 13 are formed of sheet metal, however they can also be formed from other materials that have sufficient properties to provide structural rigidity and safety enclosure for apparatus 10, such as castings, a welded fabrication and injection molding. An operator control panel 14 is positioned on each side of the apparatus 10 (FIG. 3).

Figure 2:
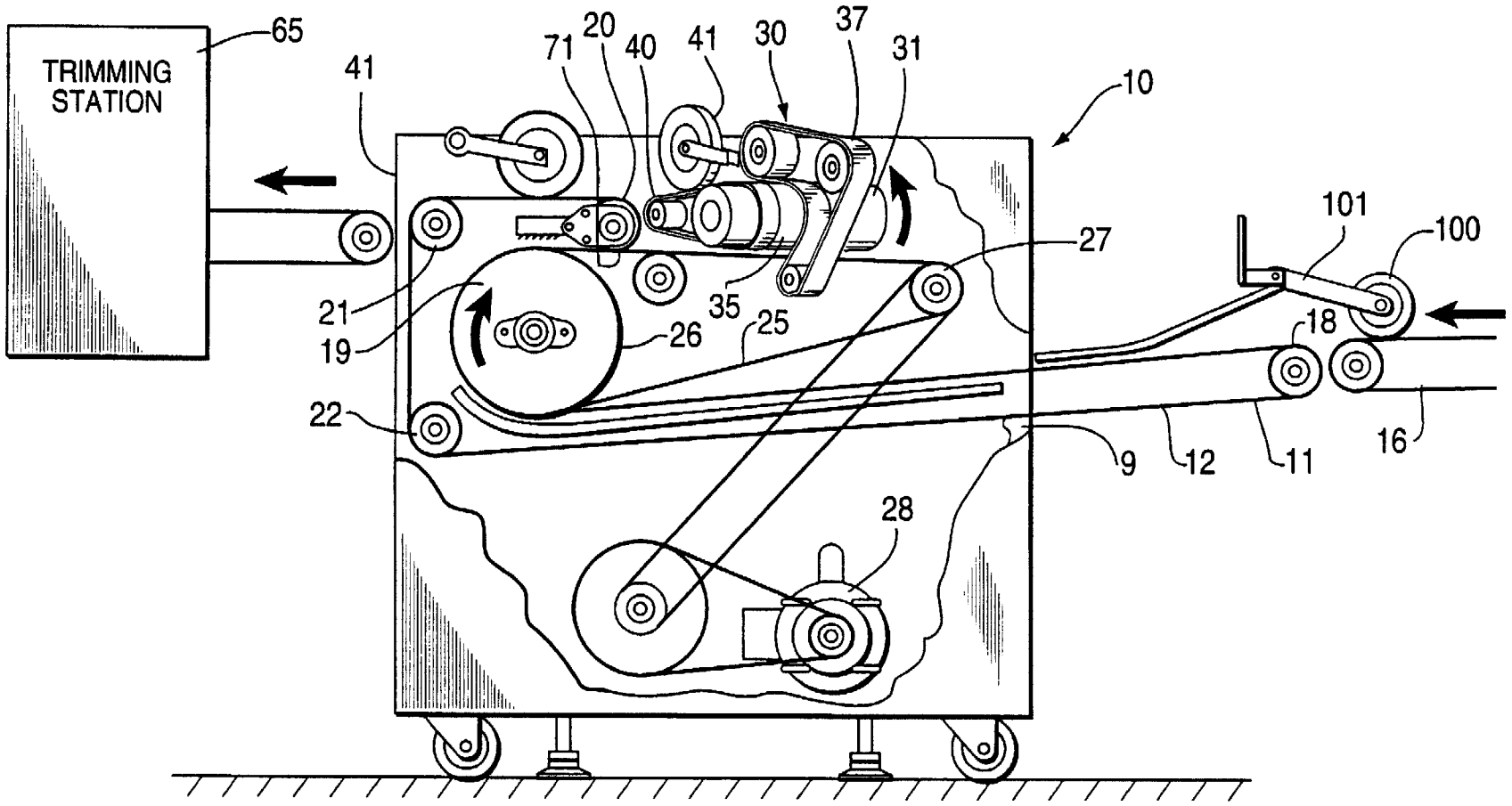
FIG. 2 is an illustrative side elevational view of the FIG. 1 apparatus for turning and re-orienting articles within a pathway.

With reference to FIG. 2, there is a fragmented illustrative side elevational view of apparatus 10. An exit conveyor 16 provides the pathway from the upstream process directly into the article pathway of apparatus 10. The input conveyor 11, which may be disposed horizontal or inclined, receives and conveys articles that are separated from one another or joined as in a lapped or shingled stream. The stream of articles in the preferred embodiment are continuously conveyed at a constant speed through the article pathway. An encoder 100 is connected to the apparatus 10 through a member 101. People of ordinary skill in the art recognize that the encoder is utilized to set the timing of the apparatus 10.

Figure 4:
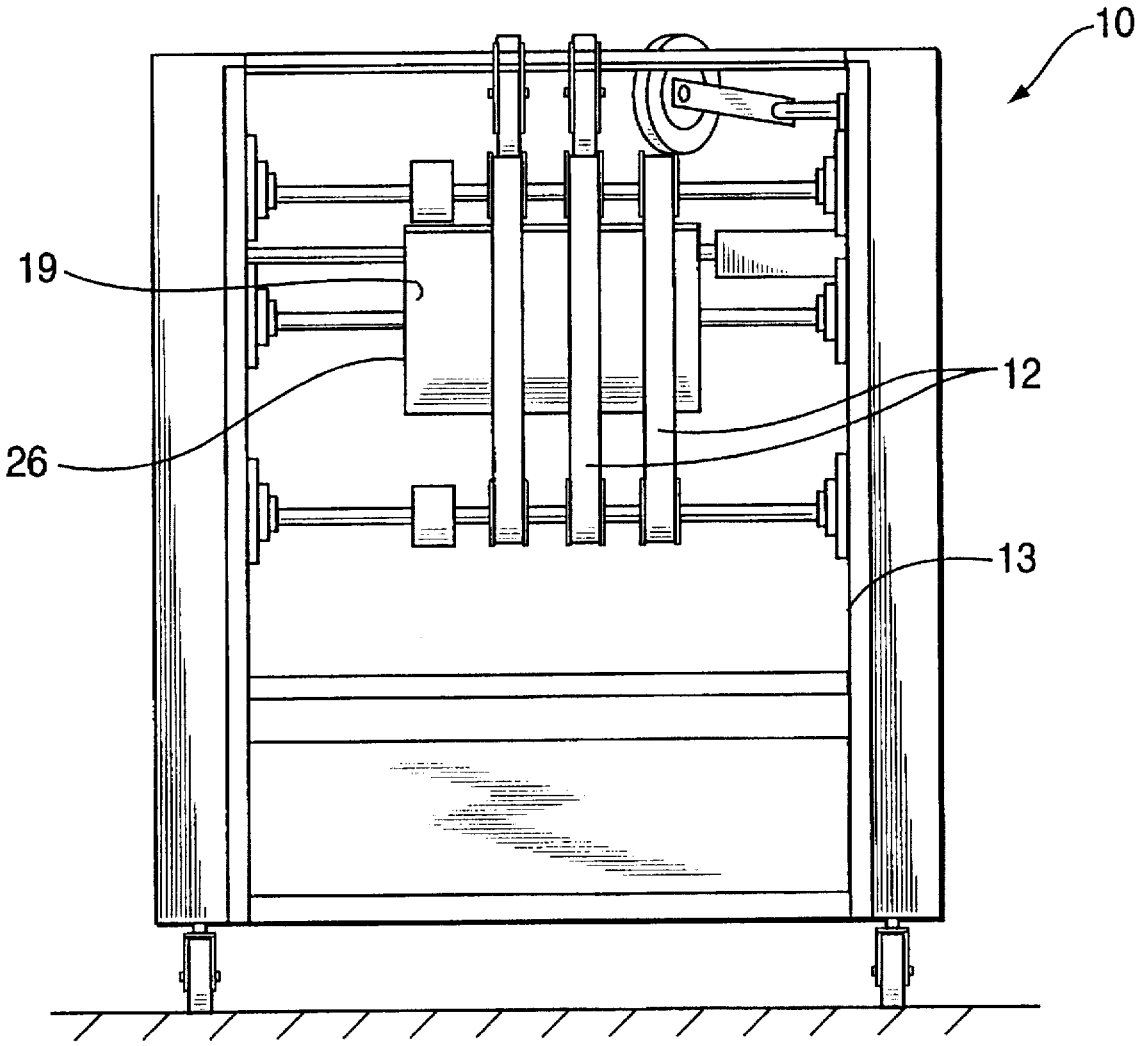
FIG. 4 is a end view of the apparatus of FIG. 1.
Figure 5:
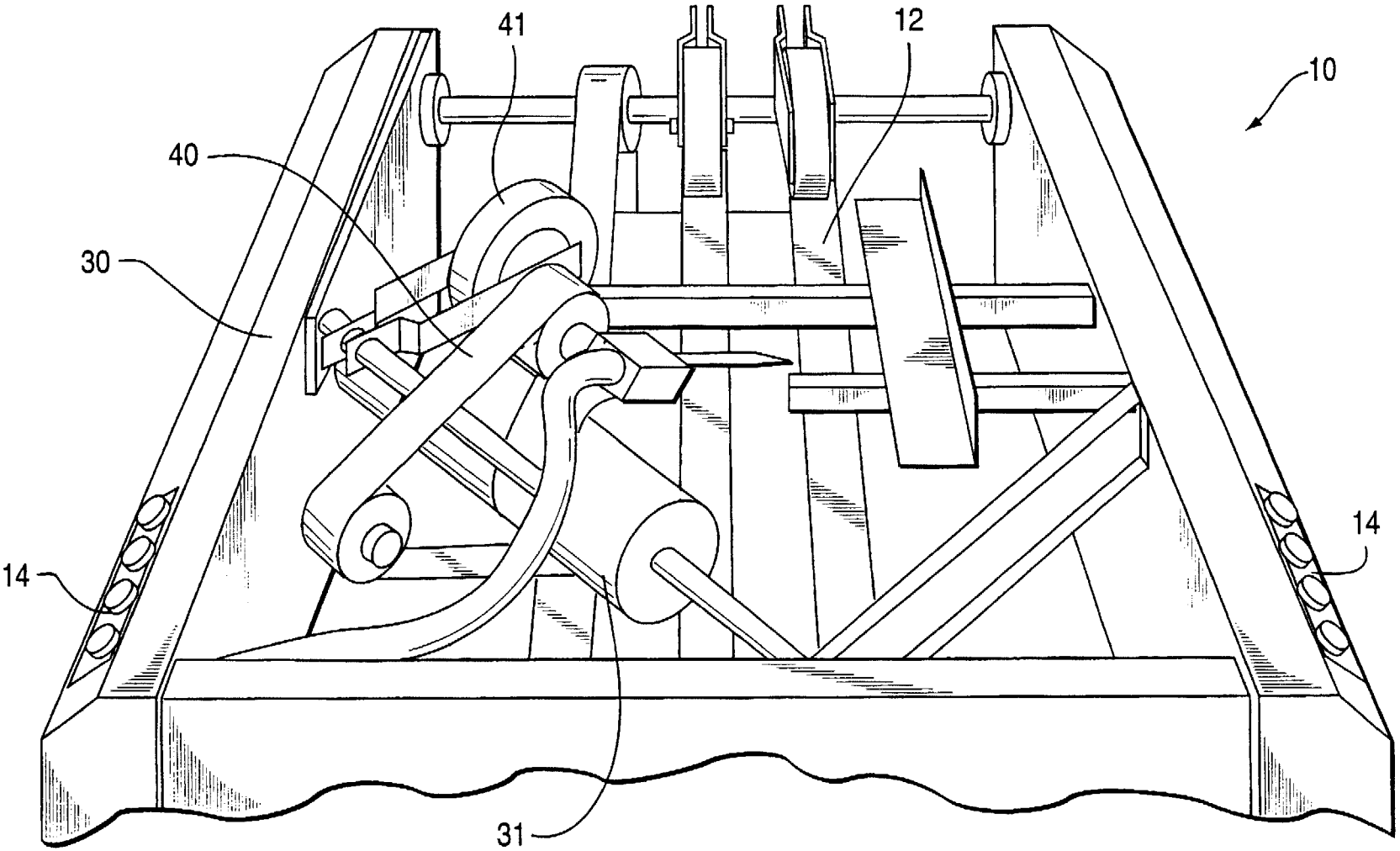
FIG. 5 is an enlarged partial perspective view of the FIG. 1 apparatus.

Input conveyor 11 having a plurality of elastic belts 12 that stretch from an initial reference point 18 and pass around about 180° of a cylindrical turning drum 19, around a roller 20, and continue around two idlers 21 and 22 and then back to the initial reference point 18. In the preferred embodiment the elastic belts 12 are spaced laterally from one another (FIG. 4), however a solid belt substantially the width of the article path and formed of alternative materials is contemplated herein. Input conveyor 11 is powered by a central drive motor 28, however distributed power is also contemplated in the present invention. The coupling of the drive motor to the conveyor is within the knowledge of people skilled in this art.

Cylindrical turning drum 19 is rotatably mounted to the frame 13, and in the preferred embodiment rotates in a clockwise direction indicated by arrow A. In the preferred embodiment the turning drum has an outside diameter of approximately ten inches. It is contemplated that the turning drum would have an outside diameter within a range of about ten to thirty-six inches. Turning drum 19 extends across the article pathway and has a plurality of elastic drive belts 25 wrapped around about 180 degrees of its circumference. Elastic article drive belts 25 that are analogous to belts 12 extend around drum 19 and roller 27. It is understood by those skilled in the art that other types of article drive belts are contemplated by the present invention.

The article elastic drive belts 25 are spaced across the article pathway and contact an outer circumferential surface 26 of the drum 19. The elastic drive belts 25 form a continuous path between the drum 19 and the roller 27. Roller 27 is a drive roller that is connected to the main drive motor 28 of apparatus 10. In the preferred embodiment this connection is by a drive belt, however other means are contemplated herein.

The elastic article drive belts 12 form a portion of the input conveyor 11 and are spaced radially outward from the elastic drive belts 25 that contact the outer surface 26 of the turning drum 19. The input conveyor article drive belts 12 and article drive belts 25 are aligned and in registry in order to minimize the wrinkling and creasing of articles passing therebetween. As the stream of articles enters the apparatus 10 they are conveyed by the input conveyor 11 to the drum 19 where they are rotated 180° around the drum, thereby inverting the article and continuing it along the pathway to a re-orienting portion 30.

The re-orienting portion 30 includes a powered drive roller 31 that is rotatable in the preferred embodiment in a counter clockwise direction. However, alternate embodiments contemplate rotation in other directions. The apparatus 10 in FIGS. 1–5, illustrates a clockwise rotation device (Referring to the rotation of the article), however a counterclockwise rotation apparatus (referring to the rotation of the article) is contemplated in another form of the present invention. The counterclockwise rotation apparatus is configured as a mirror image of the reorienting portion about an axial centerline X. The re-orienting roller 31 is positioned at an acute angle to the article pathway formed by the drive belts 25. In the preferred embodiment the axis of rotation of the re-orienting roller 31 is disposed at an acute angle of about 45° to the article pathway. Re-orienting roller 31 is substantially cylindrical and is driven by the main motor 28. In the preferred embodiment the outer surface of roller 31 is substantially smooth, however it is contemplated that a roughened surface may be necessary for certain articles. A knurled surface is utilized in one embodiment for article having a non heat set ink applied thereto. Power transmission from the roller 31 to the main drive motor 28 is accomplished by a drive belt, however other power transmission means as generally known to those skilled in the art is contemplated herein. In the preferred embodiment the re-orienting roller 31 is driven at a sufficient speed such that the horizontal component of the articles velocity remains substantially the same throughout the entire article pathway.

The plurality of elastic drive belts 25 convey the inverted moving article from the drum 19 to the angled re-orienting roller 31. A pinchpoint 35 is formed where the friction belt 37 wraps around 180° of the re-orienting roller 31. The friction belt 37 is mounted on rollers and is driven by the rotating roller 31. At pinchpoint 35 the article is engaged by moving roller 31 and driven wrappingly around the outer surface of the cylindrical roller 31. In the preferred embodiment the roller has about a four inch diameter and the article follows a helical path around the roller. Alternative forms of the present invention contemplate rollers having other outside diameters to meet the particular needs of the article. During the movement of the article around the roller 31 an edge A (FIG. 3) is re-oriented such that it is rotated ninety degrees from its first position.

An elastic belt 40 and kicker wheel 41 are connected to the re-orienting roller 31. Drive belt 40 and kicker wheel 41 function to ensure that the articles leaving the roller 31 arrive at their second re-orienting position completely abutted against a stop 60. Any articles that do not come to rest completely against the stop 60 are urged by belt 40 and kicker 41 into the second re-orienting position. Upon exiting the re-orienting portion 30 of article 10 the articles continue to travel along the article pathway to the output side 41 of apparatus 10. The article pathway to the exit point is a continuation of the moving belts 12, which have a plurality of tension wheels 66 disposed thereat.

From the output side 41 of the apparatus 10 the articles are able to be conveyed to another workstation for further processing. The additional downstream workstations include trimming stations, wind-up reels, ink jet printing, and stackers. The wind up reels are distributed by Ferag/rmo of Bristol, Pa. under the tradename MINIDISK and Muller Martini of Smithtown, N.Y. under the tradename PRINT-ROLLS.

Referring to FIG. 3, there is illustrated a top plan view of apparatus 10. The input conveyor 11 receives a plurality of shingled articles 70 that are moving at a high rate of speed, in one embodiment in the range of about 100–400 ft/minute. A pair of spaced input stream guides 90 and 91 are positioned on each side of the stream of articles. In an alternative form of the present invention the streamguides 90 and 91 are replaced with stream aligners that are utilized to remove crookedness or unevenness in the stream. The utilization of stream aligners to straighten a streamn is generally known to people skilled in the art.

The input articles 70 are conveyed through the article pathway in a continuous, uninterrupted fashion and are inverted at drum 19. Upon exiting drum 19 a pinchpoint 71 prevents the trailing articles from being fed into the roller 31. In an alternative form of the present invention the pinchpoint 71 is comprised of an adjustable structure which allows the pinchpoint to be adjusted to accommodate different article lengths. The articles continue uninterruped to the re-orienting portion 30 where they are wrapped around the roller 31, and have their orientation moved 90 degrees. If the article is not completely located against stop 60 the kicker wheel 41 and drive belt 40 urge the article thereagainst. Further, re-orienting roller 31 is moveable along its axis of rotation to adjust to different sizes of articles. A mechanical affixation such as a clamping device is utilized to lock it in place.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An apparatus for laterally rotating articles moving in a first linear direction and having a first planar orientation, to a second orientation laterally rotated and in a plane parallel to the first planar orientation and moving parallel to the first linear direction, comprising:

a moving article pathway;

a rotatable drum positioned within said pathway for inverting said moving articles from the first orientation; and a rotatable re-orienting roller positioned within said pathway and oriented with its axis of rotation at an acute angle to said pathway for re-orienting said moving articles orientation to the second orientation while said moving articles pass around at least a portion of said roller.

2. The apparatus of claim 1, wherein said moving articles are laterally rotated up to about 90°.

3. The apparatus of claim 2, wherein said moving articles are laterally rotated about 90°.

4. The apparatus of claim 1, wherein said roller is disposed at an acute angle of about 45° to said pathway.

5. The apparatus of claim 1, wherein said pathway moves at a speed of about 100 to about 400 ft/minute.

6. The apparatus of claim 1, wherein said roller and said drum permit said moving articles to be continuously conveyed at a constant speed through said pathway.

7. A method for re-orientating articles comprising:

providing an apparatus for laterally rotating articles moving in a first linear direction and having a first planar orientation, to a second orientation laterally rotated and in a plane parallel to the first planar orientation and moving parallel to the first linear direction, said apparatus comprising a moving article pathway, a rotatable drum positioned within said pathway for inverting said moving articles from the first orientation, and, a rotatable re-orienting roller positioned within said pathway and oriented with its axis of rotation at an acute angle to said pathway for re-orienting said moving articles orientation to the second orientation while said moving articles pass around at least a portion of said roller; and conveying said moving articles through said pathway.

8. An apparatus for laterally rotating a stream of overlapping signatures moving in a first linear direction and having a first linear orientation, to a second orientation which is rotated and in a parallel plane to the first orientation and moving in the first linear direction but offset therefrom which comprises:

means for moving a stream of overlapping signatures in a pathway having a first linear direction and having a first planar orientation, to a rotatable drum positioned within said pathway which inverts said stream of overlapping signatures from the first orientation; and means for laterally rotating said stream of overlapping signatures to a second planar orientation which inverts said stream of overlapping signatures, wherein said stream of overlapping signatures movers in a direction parallel to said first linear direction when in said second planar orientation.

* * * * *